US005381959A

United States Patent [19]

Malkin

[11] Patent Number: 5,381,959

[45] Date of Patent: Jan. 17, 1995

[54] STATIC SPRAYER INCLUDING PROTECTIVE COVER

[75] Inventor: Valish Malkin, Doar Gvat, Israel

[73] Assignee: Plastro Guat, Doar Gvat, Israel

[21] Appl. No.: 99,505

[22] Filed: Jul. 30, 1993

[30] Foreign Application Priority Data

Jul. 31, 1992 [IL] Israel ..... 102693

[51] Int. Cl.[6] ..... B05B 1/26; B05B 1/34

[52] U.S. Cl. ..... 239/201; 239/288.5; 239/504; 239/524

[58] Field of Search ..... 239/201, 288, 288.3, 239/288.5, 499, 500, 504, 506, 505, 514, 524, 454, 467

[56] References Cited

U.S. PATENT DOCUMENTS

| | | | |
|---|---|---|---|
| 500,853 | 7/1893 | Clark | 239/201 |
| 584,822 | 6/1897 | Macksey | 239/514 X |
| 1,639,162 | 8/1927 | Brooks | 239/505 X |
| 1,837,322 | 12/1931 | Hamilton | 239/201 |
| 1,893,210 | 1/1933 | Rider | 239/201 X |
| 2,550,100 | 4/1951 | Voss | 239/499 X |
| 3,221,995 | 12/1965 | Sievert | 239/524 X |
| 3,397,842 | 8/1968 | Frandsen | 239/524 X |
| 4,331,294 | 5/1982 | Gilad | 239/454 X |
| 4,832,264 | 5/1989 | Rosenberg | 239/506 X |
| 5,005,767 | 4/1991 | Heren | 239/288 |

FOREIGN PATENT DOCUMENTS

| | | |
|---|---|---|
| 0010925 | 5/1980 | European Pat. Off. . |
| 0130135 | 1/1985 | European Pat. Off. . |
| 2288559 | 5/1976 | France . |
| 277828 | 1/1952 | Switzerland . |
| 2173714 | 10/1986 | United Kingdom . |
| 8706859 | 11/1987 | WIPO . |

*Primary Examiner*—William Grant
*Attorney, Agent, or Firm*—Benjamin J. Barish

[57] ABSTRACT

A static sprayer includes a housing mountable in a vertical position, a diverter fixed to the housing for diverting the water from a vertically-extending passageway within the housing laterally through the water discharge outlet at the upper end of the housing, and a cover mounted for vertical movement at the upper end of the housing towards and away from the diverter to cover and uncover the water discharge outlet.

19 Claims, 3 Drawing Sheets

STATIC SPRAYER INCLUDING PROTECTIVE COVER

FIELD AND BACKGROUND OF THE INVENTION

The present invention relates to static sprayers such as are used for irrigating crops. The invention is particularly directed to a static sprayer including a protective cover to protect the sprayer from entry of insects or other foreign objects during non-operating periods of the sprayer.

Water irrigation sprayers and sprinklers are frequently left in the field for long periods of non-use. During such non-use periods, insects attracted by moisture within the sprayer or sprinkler tend to clog their discharge outlets. Such clogging of the sprayers or sprinklers by insects, or by the accumulation of other foreign objects during long periods of non-use, may result in the malfunction, or at least in the need for frequent cleaning, of the sprayers or sprinklers. In the case of rotary sprinklers, this problem has been addressed by mounting the rotary deflector of the sprinkler in such manner permitting it to drop by gravity to cover the discharge outlet when the sprinkler is not in use.

OBJECTS AND BRIEF SUMMARY OF THE INVENTION

An object of the present invention is to provide a static sprayer with protection against the entry of insects or other foreign objects during long periods of non-use.

According to the present invention, there is provided a static water sprayer comprising: a housing mountable in a vertical position and including a water inlet at the lower end of the housing, a water discharge outlet at the upper end of the housing, a vertically-extending passageway within the housing connecting the water inlet to the water discharge outlet, and a diverter fixed to the housing for receiving the water from the vertically-extending passageway and for diverting the water laterally through the water discharge outlet and laterally of the housing; characterized in that said static sprayer further comprises: a cover mounted at the upper end of the housing over the diverter and movable vertically through a linear path towards and away from said diverter to cover and uncover said water discharge outlet; and a constraining device permitting the cover to move away from the water discharge outlet a limited amount when water is discharged therefrom and permitting the cover to move towards said water discharge outlet to cover it when water is not discharged therefrom to thereby inhibit the entry of insects or other foreign objects into the sprayer.

Two embodiments of the invention are described below for purposes of example. According to further features in one described embodiment, the diverter is a deflector fixed to the housing, and the constraining device is a pin fixed to the deflector on which the cover is movably mounted. According to further features in the second described embodiment, the diverter is a vortex chamber fixed to the housing, and the constraining device includes an open cage secured to the upper end of the vortex chamber.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
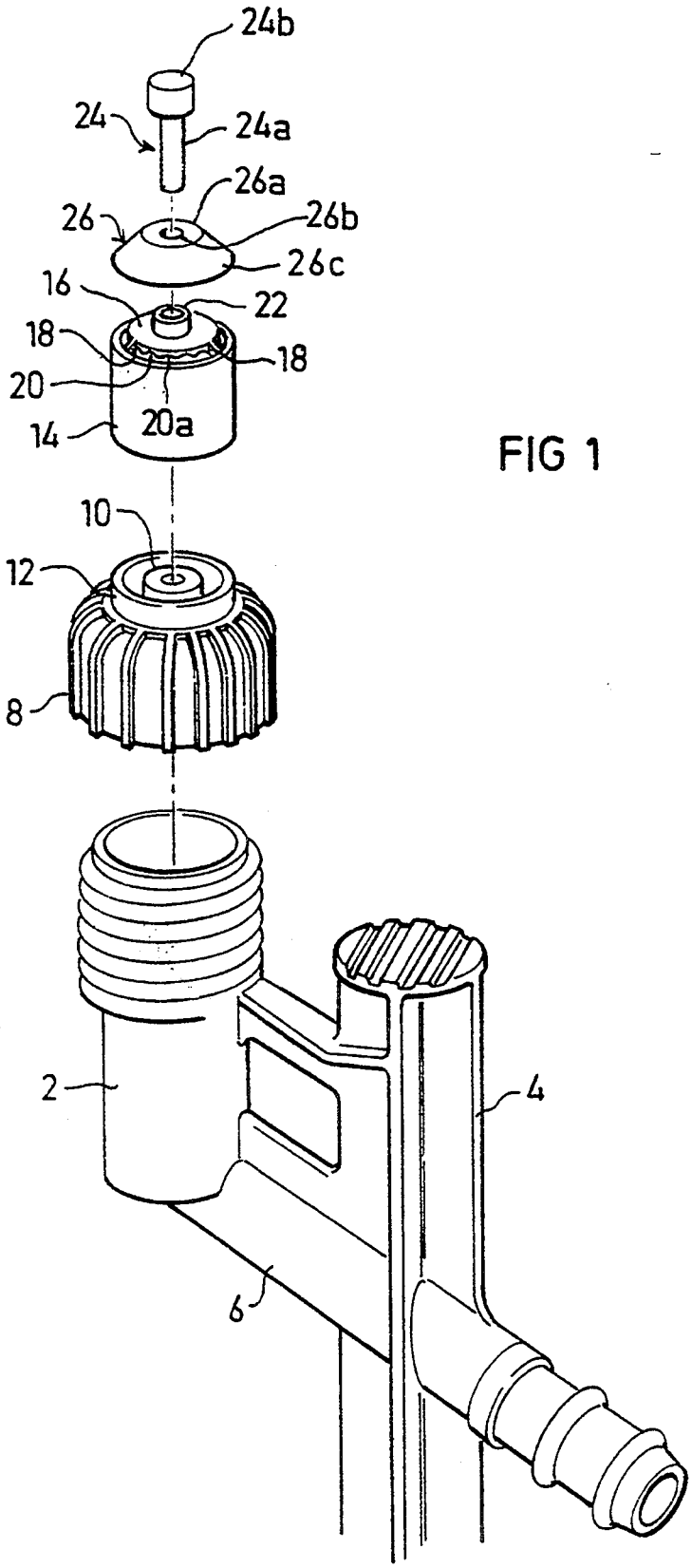
FIG. 1 is an exploded view illustrating one form of static sprayer constructed in accordance with the present invention.
Figure 2:
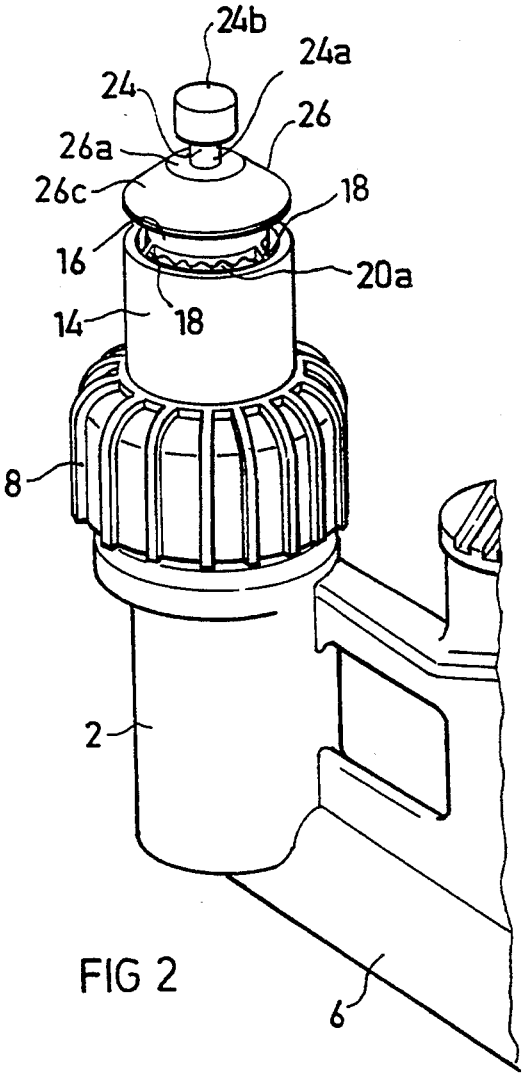
FIG. 2 is an assembled view of the static sprayer of FIG. 1, the sprayer being shown in its operating condition.
Figure 3:
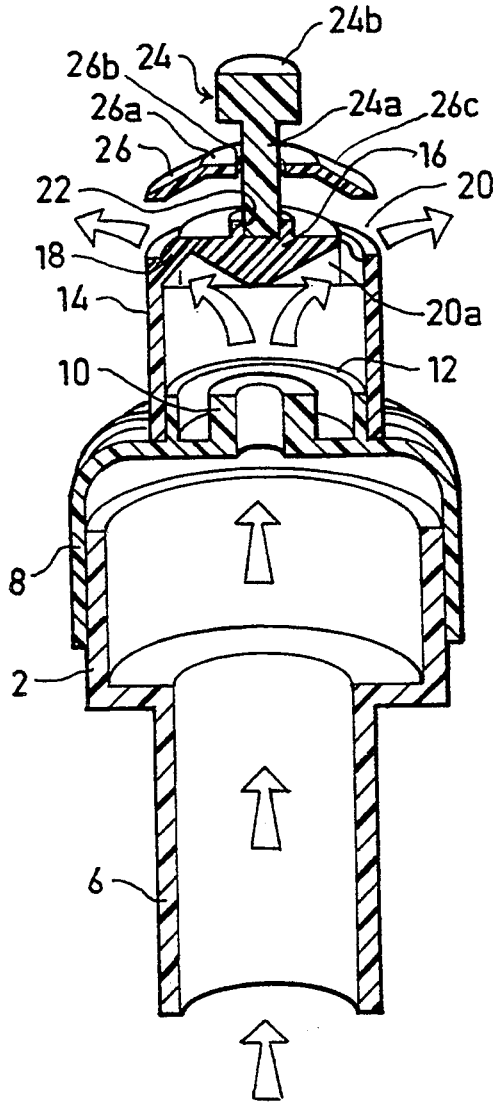
FIG. 3 diagrammatically illustrates the operation of the static sprayer of FIGS. 1 and 2.

The Embodiment of FIGS. 1–3

FIGS. 1–3 illustrate one form of static sprayer incorporating the present invention. The illustrated static sprayer includes a housing 2 secured to the upper end of a stand 4 for mounting the housing in a vertical position. Housing 2 and stand 4 may be integrally formed as a single unit, e.g., by injection moulding, to also include a water inlet 6 at the lower end of the housing connectible to a water supply line (not shown). A cap 8 is threadedly applied to the upper end of the housing.

Cap 8 is formed at its upper end with a vertically-extending passageway in the form of a nozzle 10 through which the water flows as a vertical jet. Nozzle 10 is circumscribed by a collar 12 which receives a cylindrical wall 14. This cylindrical wall is fixed to cap 8 in any suitable manner, e.g., by a force-fit or threaded-fit over collar 12, so that the cylindrical wall coaxially encloses, and is fixed to, nozzle 10.

A water diverter, in the form of a deflector 16, is fixed by a plurality of bridges 18 to the upper end of the cylindrical wall 14 in vertical alignment with nozzle 10 and spaced above the cylindrical wall to define an annular water discharge outlet 20 extending peripherally around the sprayer housing 2. The undersurface of deflector 16 is of convex conical configuration and is formed with a plurality of radially-extending ribs, as shown at **20*a*, to divert the water discharged from nozzle 10 laterally through the annular water discharge outlet 20**.

A socket 22 is integrally formed in the upper face of deflector 16 for mounting a pin 24 and a cover 26. Pin 24 is formed with a shank **24*a* received, as by a force-fit, into socket 22, and terminates at its outer end in an enlarged head 24*b*. Cover 26 includes a central flat section 26*a*, formed with a central hole 26*b*, and an outer conical section 26*c***.

The diameter of hole **26*b* in cover 26 is larger than that of the pin shank 24*a*, but smaller than that of the enlarged head 24*b*. Thus, pin 24 serves as a constraining device permitting the cover to move by gravity towards the water discharge outlet 20 to cover it when the sprayer is not in use, and to move away from the water discharge outlet a limited amount, limited by head 24*b***, to allow water to be discharged from the water sprayer during operation of the sprayer.

Thus, during non-operational periods of the water sprayer, the cover 26 drops by gravity onto the top of the deflector 16, such that the conical section **26*c* of the cover encloses and thereby covers the annular water discharge outlet 20, inhibiting insects or other foreign objects from entering the water discharge outlet. However, as soon as pressurized water is applied to the sprayer, the water discharged from the annular outlet 20, between the cylindrical wall 14 and the deflector 16, impinges against the inner surface of the conical section 26***c* of the cover 26 to move the cover vertically through a linear path towards and away from deflector (diverter) 16 to cover and uncover the annular water discharge outlet 20, and thereby to permit the water to be discharged via the annular discharge outlet 20, as shown in FIG. 2 of the drawings.

Hole 26*b* in the central section 26*a* of the cover 26 is of significantly larger diameter than shank 24*a* of the pin 24 such that the interior of the cover is vented to the atmosphere during periods of non-use of the sprinkler. This permits water trapped in the sprayer, particularly between the underface of the cover 26 and the water discharge outlet 20, to drain through the sprayer. The Embodiment of FIGS. 4–6

Figure 4:
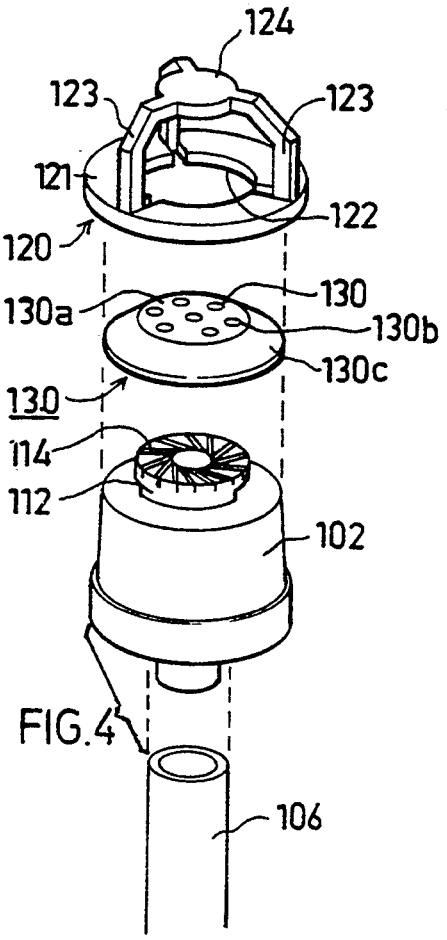
FIGS. 4–6 are views corresponding to those of FIGS. 1–3, respectively, but illustrating a second form of static sprayer constructed in accordance with the present invention.
Figure 5:
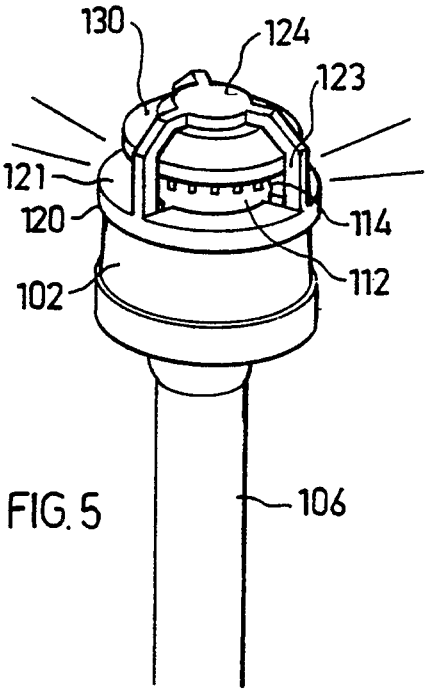
Figure 6:
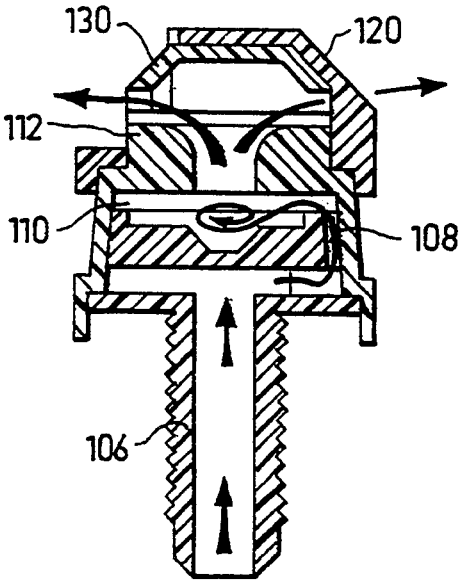

The sprayer illustrated in FIGS. 4–6 is also a static sprayer having a diverter, an annular discharge outlet, and a cover covering the outlet during non-use of the sprayer. In this case, howevever, the diverter producing the annular discharge from the sprayer is a vortex chamber, rather than a conical deflector as in the sprayer of FIGS. 1–3; also, the cover movements are constrained by a cage rather than by a pin.

Thus, the static sprayer illustrated in FIGS. 4–6 includes a housing 102 which is adapted to be mounted in a vertical position, e.g., by a stand such as shown at 4 in FIG. 1. As shown particularly in FIG. 6, housing 102 includes an inlet 106 at its lower end for entering the water, and a vertically-extending passageway 108 which directs the water substantially tangentially into a vortex chamber 110 defined by a cylindrical wall 112 secured to the upper end of the housing. The upper end of cylindrical wall 112 is cut with a plurality of slots 114 (FIGS. 4 and 5) extending substantially tangentially to the cylindrical wall through which the water is discharged. Slots 114 thus define an annular discharge outlet extending peripherally around the sprayer housing 102.

A cage, generally designated 120, is secured to the upper end of diverter chamber 110 to circumscribe the cylindrical wall 112 defining the annular discharge outlet of the sprayer. Cage 120 includes a disc 121 secured, e.g., by adhesive, to the upper surface of wall 112 of the vortex chamber 110 and formed with a central opening 122 enclosing the outer face of cylindrical wall 112. Cage 120 is further formed with a plurality of vertically-extending legs 123 converging at their upper ends and joined to a central disc 124.

A protective cover 130 is disposed within cage 120 so as to overlie the upper end of cylindrical wall 112 of the sprayer. Cover 130 includes a central flat section 130*a* formed with a plurality of holes 130*b*, and an outer conical section 130*c*.

It will thus be seen that the cage serves as a constraining device which, in the absence of a water discharge from the sprayer, permits the cover 130 to move by gravity to cover the water discharge outlet (namely the annular array of slots 114 formed in the upper surface of the vortex chamber wall 112) and thereby to inhibit the entry of insects or other foreign objects into the sprayer. However, when pressurized water is entered into the sprayer, the water discharged from the slots 114 laterally around the sprayer impinges against the inner surface of the conical section 130*c* of cover 130, and moves the cover upwardly a limited amount, limited by the upper disc section 124 of the cage, to permit the water to be discharged from the sprayer as shown in FIG. 5.

The holes 130*b* in the central section 130*a* of the cover 130 vent the interior of the cover to the atmosphere, and thereby permit water trapped in the sprayer, particularly between the underface of the cover and the water discharge outlet (slots 114 at the upper end of the vortex chamber wall 112), to drain through the sprayer.

While the invention has been described with respect to two preferred embodiments, it will be appreciated that these are set forth merely for purposes of example, and that many other variations, modifications and applications of the invention may be made.

What is claimed is:

1. A static sprayer, comprising: a housing mountable in a vertical position and including a water inlet at the lower end of the housing, a water discharge outlet at the upper end of the housing, a vertically-extending passageway within the housing connecting the water inlet to the water discharge outlet, and a static diverter fixed to the housing for receiving the water from the vertically-extending passageway and for diverting the water laterally through the water discharge outlet and laterally of the housing said diverter defining said discharge outlet in a fixed annular configuration; characterized in that said static sprayer further comprises: a cover mounted at the upper end of the housing over said diverter and movable vertically through a linear path towards and away from said diverter to cover and uncover said water discharge outlet; and a constraining device permitting the cover to move away from the water discharge outlet a limited amount when water is discharged therefrom, and permitting the cover to move by gravity towards said water discharge outlet to cover it when water is not discharged therefrom to thereby inhibit the entry of insects or other foreign objects into the sprayer.

2. The static sprayer according to claim 1, wherein said water discharge outlet extends peripherally around the sprayer housing to discharge the water in the form of an annular spray around the housing, and said cover includes an outer section adapted to cover said annular water discharge outlet.

3. The static sprayer according to claim 2, wherein said outer section of the cover is of conical configuration.

4. The static sprayer according to claim 1, wherein said constraining device includes a pin having a shank secured vertically to the upper end of said diverter and an enlarged head at the upper end of said pin; said cover having a central hole larger than the shank of said pin but smaller than said enlarged head.

5. The static sprayer according to claim 4, wherein said central hole in the cover is significantly larger than the shank of the pin such as to vent the interior of the cover to the atmosphere and thereby to permit water trapped between the underface of the cover and the water discharge outlet to drain through the sprayer.

6. The static sprayer according to claim 1, wherein said diverter is a deflector having an undersurface of conical configuration to deflect the water outletted from said vertically-extending passageway laterally through said water discharge outlet.

7. The static sprayer according to claim 1, wherein said constraining device includes an open cage secured to the upper end of said diverter and enclosing said cover.

8. The static sprayer according to claim 7, wherein said cover is formed with a plurality of holes to vent the interior of the cover to the atmosphere, and thereby to permit water trapped between the underface of the cover and the water discharge outlet to drain through the sprayer.

9. The sprayer according to claim 7, wherein said diverter includes a cylindrical wall defining a vortex chamber; the upper end of said cylindrical wall being formed with a plurality of slots extending substantially tangentially to said vortex chamber to define said water discharge outlet; said cage being secured to the upper end of said cylindrical wall.

10. A static sprayer, comprising:

a housing mountable in a vertical position and including a water inlet at the lower end of the housing, a water discharge outlet at the upper end of the housing, and a vertically-extending passageway within the housing connecting the water inlet to the water discharge outlet;

a deflector fixed to the housing and having an undersurface of convex conical configuration to deflect the water outletted from said vertically-extending passageway laterally through said water discharge outlet and laterally of said housing;

a cover mounted at the upper end of the housing over said deflector and movable vertically through a linear path towards and away from said deflector to cover and uncover said water discharge outlet;

and a constraining device permitting the cover to move away from the water discharge outlet a limited amount when water is discharged therefrom, and permitting the cover to move by gravity towards said water discharge outlet to cover it when water is not discharged therefrom to thereby inhibit the entry of insects or other foreign objects into the sprayer.

11. The static sprayer according to claim 10, wherein said water discharge outlet is of annular configuration and extends peripherally around the sprayer housing to discharge the water in the form of an annular spray around the housing, and said cover includes an outer section adapted to cover said annular water discharge outlet.

12. The static sprayer according to claim 11, wherein said outer section of the cover is of conical configuration.

13. The static sprayer according to claim 10, wherein said constraining device includes a pin having a shank secured vertically to the upper end of said deflector and an enlarged head at the upper end of said pin; said cover having a central hole larger than the shank of said pin but smaller than said enlarged head.

14. The static sprayer according to claim 13, wherein said central hole in the cover is significantly larger than the shank of the pin such as to vent the interior of the cover to the atmosphere and thereby to permit water trapped between the underface of the cover and the water discharge outlet to drain through the sprayer.

15. A static sprayer, comprising:

a housing mountable in a vertical position and including a water inlet at the lower end of the housing, a water discharge outlet of fixed annular configuration at the upper end of the housing, and a vertically-extending passageway within the housing connecting the water inlet to the water discharge outlet;

a vortex chamber fixed to the housing for receiving the water from the vertically-extending passageway and for diverting the water laterally through said annular water discharge outlet at the upper end of the housing and laterally of said housing;

a cover mounted at the upper end of the housing over said vortex chamber and movable linearly towards and away from said vortex chamber to cover and uncover said water discharge outlet;

and a constraining device permitting the cover to move away from the water discharge outlet a limited amount when water is discharged therefrom, and permitting the cover to move by gravity towards said water discharge outlet to cover it when water is not discharged therefrom to thereby inhibit the entry of insects or other foreign objects into the sprayer.

16. The static sprayer according to claim 15, wherein said cover includes an outer section of conical configuration adapted to cover said annular water discharge outlet.

17. The static sprayer according to claim 15, wherein said cover is formed with a plurality of holes to vent the interior of the cover to the atmosphere, and thereby to permit water trapped between the underface of the cover and the water discharge outlet to drain through the sprayer.

18. The static sprayer according to claim 15, wherein said constraining device includes an open cage secured to the upper end of said vortex chamber and enclosing said cover.

19. The sprayer according to claim 18, wherein said vortex chamber includes a cylindrical wall formed at its upper end with a plurality of slots extending substantially tangentially to said cylindrical wall to define said annular water discharge outlet; said cage being secured to the upper end of said cylindrical wall.

* * * * *